United States Patent [19]

Walter

[11] Patent Number: 5,044,508

[45] Date of Patent: Sep. 3, 1991

[54] GOODS PRESENTATION SYSTEM HAVING HEIGHT-ADJUSTABLE BRACKET ELEMENTS IN A WALL ARRANGEMENT OR PILLAR ARRANGEMENT

[75] Inventor: Herbert Walter, Müllheim, Fed. Rep. of Germany

[73] Assignee: Protoned B.V., Amsterdam, Netherlands

[21] Appl. No.: 537,561

[22] Filed: Jun. 12, 1990

[30] Foreign Application Priority Data

Jun. 23, 1989 [CH] Switzerland ..... 2356/89

[51] Int. Cl.[5] ..... A47B 47/00

[52] U.S. Cl. ..... 211/207; 248/244

[58] Field of Search ..... 211/207; 248/221.3, 248/222.1, 307, 244

[56] References Cited

U.S. PATENT DOCUMENTS

| | | | |
|---|---|---|---|
| 2,677,519 | 5/1954 | Hobson | 211/207 X |
| 3,807,574 | 4/1974 | Lanza | 211/207 |
| 4,753,354 | 6/1988 | Patterson et al. | 211/207 X |
| 4,919,282 | 4/1990 | Duff et al. | 211/207 X |

FOREIGN PATENT DOCUMENTS

| | | |
|---|---|---|
| 657109 | 8/1986 | Switzerland . |
| 658174 | 10/1986 | Switzerland . |

*Primary Examiner*—Ramon O. Ramirez

*Attorney, Agent, or Firm*—Ralph W. Selitto, Jr.

[57] ABSTRACT

Goods presentation system having slide devices which are displaceable in a longitudinal direction in a C-section rail (1, 1.1) and which can be engaged on predetermined support points (10), for the mounting of support devices to accommodate goods. These slide devices are designed as control locks (3) which can be pushed into the internal space of the section from the front through the section opening and which contain locking jaws (9) which are mounted transversely displaceably in a lock housing (8). The locking jaws (9) can optionally be displaced from an extended locking position, in which they project beyond the lateral walls (8.1) of the housing and in conjunction with the support points (10) establish engagement points for the support devices, into a running position, in which the lock housing (8) is freely displaceable in the C-rail (1, 1.1).

The control lock is provided with a cover plate, the front surface (11) of which is intended to receive the support devices.

6 Claims, 2 Drawing Sheets

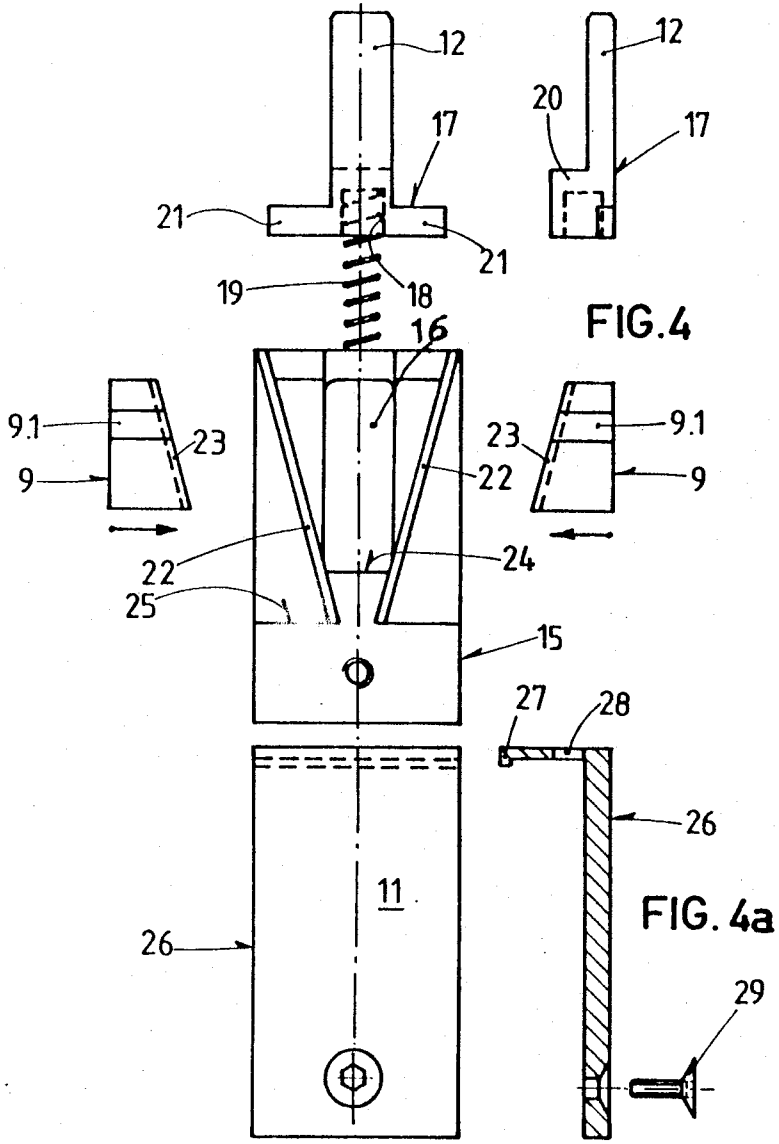
FIG.4
FIG.4a
12
17
20
21
18
16
19
9.1
9
23
22
24
15
25
11
26
27
28
29
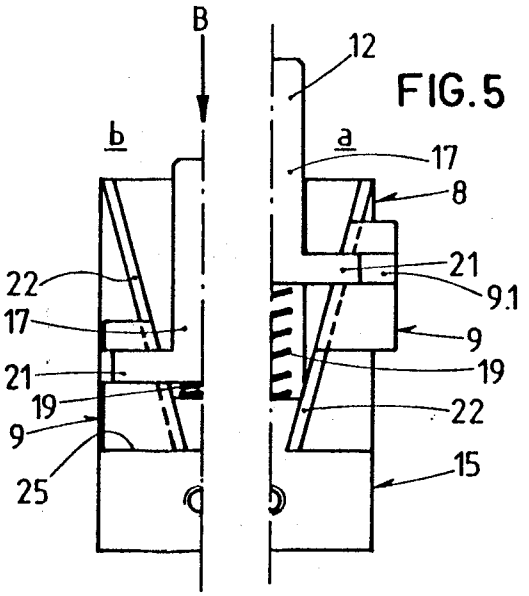
FIG.5
12
a
17
8
21
9.1
9
19
22
15
B
b
25
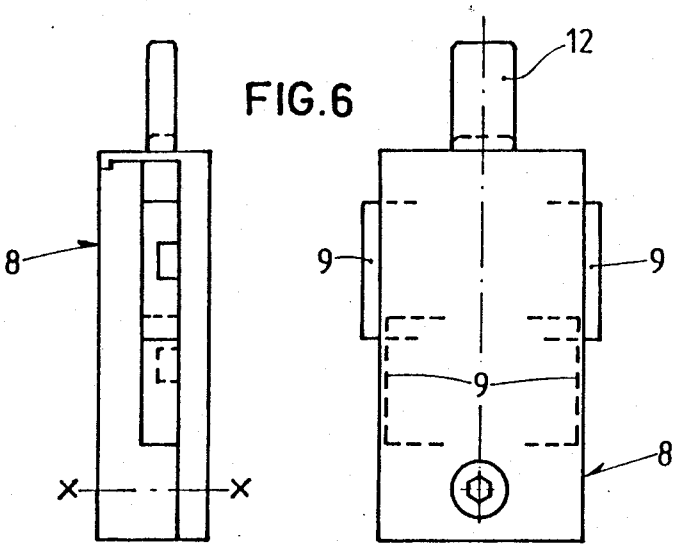
FIG.6
12
9
8
X

GOODS PRESENTATION SYSTEM HAVING HEIGHT-ADJUSTABLE BRACKET ELEMENTS IN A WALL ARRANGEMENT OR PILLAR ARRANGEMENT

The present invention relates to a goods presentation system according to the preamble of claim 1.

In Swiss Patent Specification No. 658,174, a goods presentation rack of the type constructed from elements is described, in which anchoring parts, which are provided with pairs of claw members and support goods support devices which can be fixed at selectable heights, are hung on a rack frame made of profiled pillar elements. The anchoring parts are coupled to the pillar elements by swiveling hook members into openings of the former and they form sturdy, highly loadable connections between the pillar elements and the goods support devices.

In Swiss Patent Specification No. 657,109, a support rack having crosspieces which are removably attached to pillar elements is described, in which a clamping device with expanding legs is intended to engage in longitudinal slots on the pillar elements and by these means to create a rigid, rapidly removable connection between neighboring pillar elements.

In both publications there are connection elements between profiled pillar elements, which make necessary an enlargement of the distances between neighboring pillar elements upon dismantling of the rack arrangements. Consequently, they cannot be used for brackets which are intended to be detachable directly from their mounting plane. In the case of both connection elements, subsequent extensions to a support construction assembly using them are practically excluded.

The aim of the invention is, therefore, to produce a goods presentation system having height-adjustable bracket elements in a wall arrangement or pillar arrangement, in which single-armed or multi-armed support devices are inserted as required into the latter in slide sections, which are open on the front side, and can be freely selectably engaged and disengaged with regard to height.

The solution to this aim consists in a goods presentation system of the type mentioned in the introduction, which is defined according to the features of patent claim 1.

Embodiments thereof are defined by the dependent claims.

The advantage of a goods presentation system according to the invention consists in that support devices such as clothes hanging rails, single-arm or multi-arm brackets, shelf-holders, etc. can, by means of retraction of locking jaws on slide devices, be introduced directly into a C-section opening of wall support devices or pillar support devices and engaged at the required height under the effect of gravity.

Figure 1:
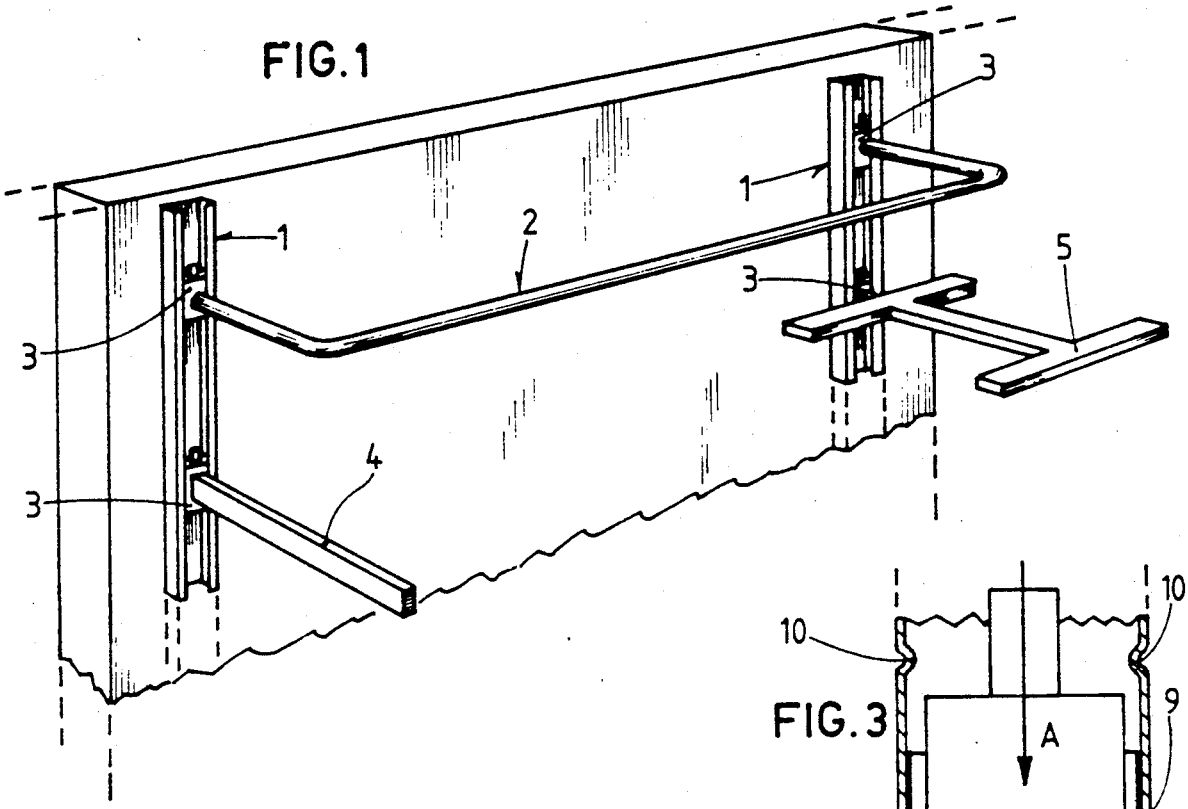
Figure 2:
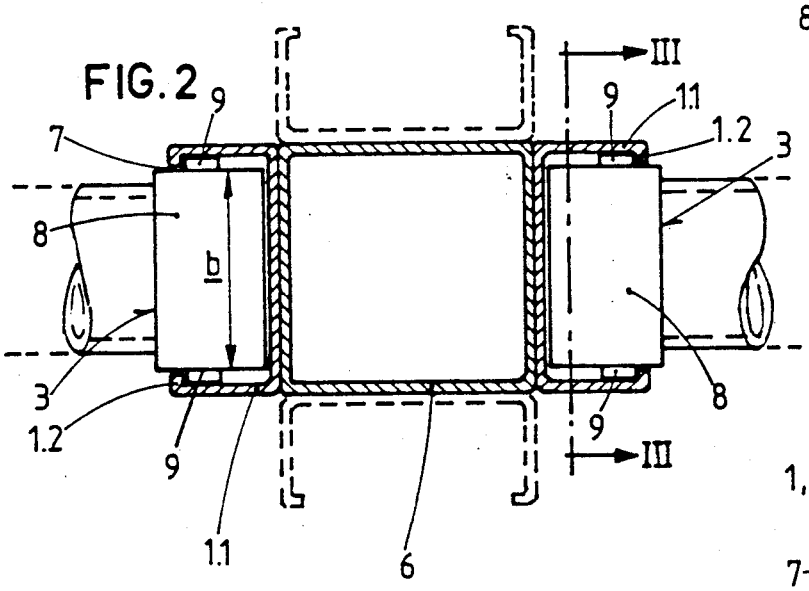
Figure 3:
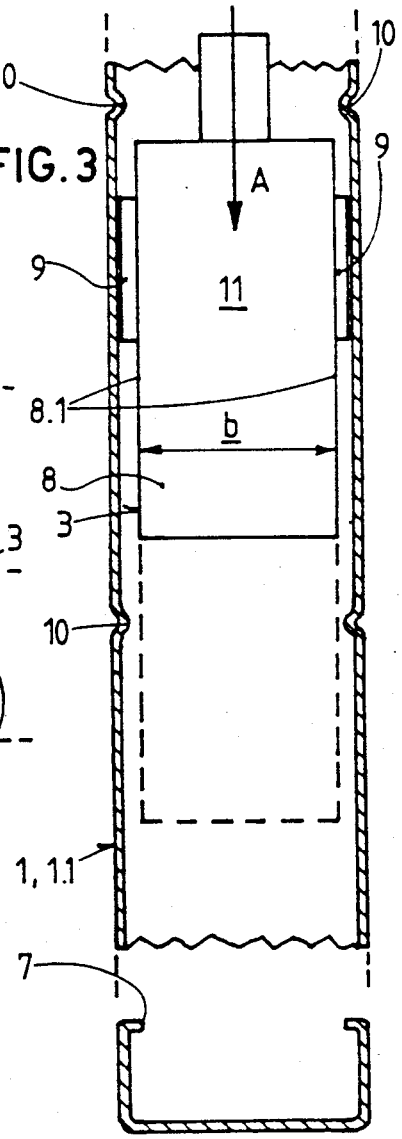

The invention is explained below by way of example, wherein:

FIG. 1 shows the goods presentation system according to the invention in a wall support arrangement with different support devices, FIG. 2 shows a cross-sectional plan view of the invention in a pillar support arrangement, FIG. 3 shows a cross-section according to the line III—III in FIG. 2, FIG. 4 shows the components of the control lock in an exploded representation, FIG. 4*a* shows the control lock cover in longitudinal cross-section, FIG. 5 shows the control lock components assembled a) on the right of the center line in the (released) locking condition of the locking jaws, and b) on the left of the center line in the (pushed in) disengaged condition, and FIG. 6 shows the control lock in a plan view and a side view.

In the wall support arrangement according to FIG. 1, there are two vertically positioned C-rails 1 which are connected at a distance to a support wall, built into a groove or surface-mounted. Three examples of support devices, which can be used with a goods presentation system according to the invention, are shown: a projecting clothes hanging rail 2 which extends between two C-rails 1 and has a control lock 3 at each end, and a single-arm bracket 4 which can be positioned either horizontally or inclined upwards or downwards as required, as well as bent laterally outwards, and is arranged on the C-rail 1 using a single control lock 3. Additionally, there is a schematically represented shelf-holder 5 which is likewise connected to the C-rail 1 using a single control lock 3. The arrangement of the rails 1 can take place in the same plane or in two different parallel planes.

FIG. 2 shows the goods presentation system in a pillar arrangement, in which two C-rails 1.1 are diametrically attached to a polygonal profiled pillar 6. The additional C-rails, shown in broken lines on the two free polygon sides, are intended to show that practically no restrictions exist for the pillar design, provided that the opening 7 of each C-rail is directed radially outwards.

The C-rail 1, 1.1 in the form of a profiled bar with a continuous longitudinal opening 7, which is delimited on both sides by profiled ribs 1.2, and the control lock 3, which has a lock housing 8, described with reference to FIGS. 3 to 6, and laterally extendable locking jaws 9, interact as follows: the control lock housing 8, which has a width b, fits with low play into the opening 7 of the C-rail and is longitudinally displaceable therein. The control lock 3 is introduced into the rail opening 7, with the locking jaws 9 retracted, until the housing 8 stands on the section base. Then the locking jaws 9 are released whereupon they make contact behind the profiled ribs 1.2 in such a manner that the control lock 3 can be moved with low play on the inside of the section between paired lateral stop means in the form of impressed projections 10. The impressed projections 10 allow the lock housing 8 to pass freely but, for extended locking jaws 9, form stop points on which the control lock 3 is supported in the rail 1, 1.1. In the case of multi-rail support arrangements there are thus formed, at defined corresponding heights on the C-rails, support points on which goods support devices, which are connected to the front surface 11 of the lock housing 8, can be fixed with regard to height.

In FIG. 3, the control lock 3 is shown with extended locking jaws 9 at a point between two paired impressed projections 10. If the control lock 3 is moved in the direction of the arrow A so far downwards until the lower ends of the locking jaws 9 rest on the lower impressed projections 10, a sturdy support position is thus achieved for the control lock 3 and a support device connected to the front surface 11 of the latter. If the control lock 3 is moved upwards against the upper impressed projections, the locking jaws 9 then recede against the tension of a spring, as will be explained below. If, on the other hand, it is desired to lower the control lock 3 below the lower impressed projections 10, an actuating rod 12 must be moved downwards by means of light finger pressure, whereupon the locking jaws 9 move downwards/inwards according to the following description and free the movement path for the control lock 3.

In FIG. 4, the components of the control lock 3 are shown in an exploded representation. The main component is a base block 15 of the housing 8, which has a first guide groove 16 to accommodate a control member 17 bearing the actuating rod 12, which member on the one hand contains in a guide block 20 a drilling, which is designed as a spring housing 18 for a pressure spring 19, and on the other hand bears a control crosspiece 21 for the locking jaws 9. The base block 15 also contains a pair of second guide grooves 22 which run inwards at an angle in an axially symmetrical manner and in which a control rib 23, which is arranged on the back of each of the locking jaws 9, engages. The locking jaws 9 are of parallelepiped design and have an inclined inner edge, which corresponds to the inclination of the guide grooves 22, and an outer contour which runs parallel to the longitudinal side of the housing. Transverse grooves 9.1 on the front side of the locking jaws 9 each serve to accommodate one of the control crosspieces 21 on the control member 17. A support surface 24 at the lower end of the first guide groove 16 serves to support the pressure spring 19 and a stop surface 25 at the lower end of the second guide grooves 22 limits the downward/inward movement of the locking jaws 9.

The base block 15 is provided with a cover plate 26, on the outer side of which the abovementioned front surface 11 for the fastening of a relevant support device 2, 4, 5, etc. is also situated. The upper end of the cover plate 26 is provided with a closing crosspiece 27 which contains a penetration opening 28 for the actuating rod 12. In conjunction with a screw connection 29 at the lower end of the cover plate 26, a sturdy construction of the control lock 3 is thus brought about.

In the right-hand half of FIG. 5 denotes as a, the arrangement of the lock components (without cover plate 26) is shown in the rest position or locking position of the locking jaws 9. The locking jaws 9 are by means of their control ribs 23 (FIG. 4) in engagement with the second guide grooves 22. They lie in the base block 15 of the lock housing 8 (FIG. 6) in such a manner that the control crosspieces 21 on the control member 17 engage in the transverse grooves 9.1 of the locking jaws 9. The control member 17, under the pressure of the tension of the pressure spring 19, is in its most extreme position of extension which is afforded by the engagement of the guide block 20 (FIG. 4) in the first guide groove 16. The locking jaws 9 are at the same time in their locking position, in which they project beyond the external surfaces of the housing. The actuating rod 12 on the control member 17 projects fully above the housing 8.

If the actuating rod 12 i now pressed downwards according to the arrow B in the left-hand half of FIG. 5 denoted as b, the locking jaws 9 are moved, by the control crosspieces 21, downwards along the second guide grooves 22, which run inwards at an angle, into their retracted or release position inside the housing contour. At the same time, the guide block 20 on the control member 17 moves downwards in the first guide groove 16, the locking jaws 9 reach the stop surface 25 and the pressure spring 19 is compressed. In this position of the components of the control lock 3, the latter is freely longitudinally movable in the C-rail and can be brought into any required height position. By releasing the actuating rod 12, the control member 17 returns, under the tension of the spring, into its initial position at the top, the locking jaw 9 also being moved outwards again and bringing about a stop at the time of the next downward movement of the control lock 3.

It can be seen from FIGS. 3 and 5 how the control lock 3 can be pushed past the impressed projections 10 of the C-rails 1, 1.1 in the upward direction of movement without pressing the actuating rod 12: as soon as one of the upper ends of the locking jaws 9 comes up against one of the impressed projections 10, by means of the coupling effect of the control member 17, both locking jaws 9 are moved downwards and inwards through the second guide grooves 22 until the locking jaws 9 can pass between the relevant projections 10.

FIG. 6 shows the control lock 3 in assembled condition in a plan view and a side view, the locking jaws 9 and the actuating rod 12 being illustrated in the locking position using unbroken lines and in the release position using broken lines.

I claim:

1. An adjustable rack presentation system for wall and pillar arrangements, comprising at least one rail member having a C-shaped longitudinal opening and at least one slide device movably received within said opening of said rail member, said slide device including a housing which has attaching means for releasably attaching a support member to said housing, an upper end, a lower end, a central longitudinal axis extending between said upper and lower ends, a first guide groove aligned with said central longitudinal axis, a pair of second guide grooves, one of said second guide grooves being positioned on one side of said central longitudinal axis and extending from said upper end of said housing towards said lower end and said central longitudinal axis thereof and the other of said second guide grooves being positioned on an opposite side of said central longitudinal axis and extending from said upper end of said housing towards said lower end and said central longitudinal axis thereof whereby said second guide grooves converge downwardly with respect to each other, locking means extending from opposite sides of said housing for releasably locking said side device in a fixed position relative to said rail member, said locking means including a first locking jaw slidably mounted in one of said second guide grooves for movement relative to said housing between an extended position, in which said first locking jaw engages said rail member, and a retracted position, in which said first locking jaw disengages said rail member, and a second locking jaw slidably mounted in the other of said second guide grooves for movement relative to said housing between an extended position, in which said second locking jaw engages said rail member, and a retracted position, in which said second locking jaw disengages said rial member, each of said first and second locking jaws having a transverse groove therethrough, and controlling means movably mounted in said first guide groove for controlling the operation of said locking means, said controlling means having a first crosspiece received in said transverse groove of said first locking jaw and a second crosspiece received in said transverse groove of said second locking jaw, and said controlling means being movable along said first guide groove between a first position, in which said first and second crosspieces maintain said first and second locking jaws, respectively, in their extended positions, and a second position, in which said first and second crosspieces maintain said first and second locking jaws, respectively, in their retracted positions.

2. An adjustable rack presentation system according to claim 1, wherein said slide device includes a pressure spring interposed between said controlling means and said first guide groove such that said controlling means is urged into its said first position.

3. An adjustable rack presentation system according to claim 1, wherein said rail member includes at least one pair of projections impressed into said rail member and protruding into said opening thereof, said projections being arranged on opposite sides of said rial member from each other and being spaced apart by a distance that is greater than the width of said housing of said slide device, whereby said projections are engagable by said locking jaws when said locking jaws are in their extended positions.

4. An adjustable rack presentation system according to claim 2, wherein said rail member includes at least one pair of projections impressed into said rail member and protruding into said opening thereof, said projections being arranged on opposite sides of said rail member from each other and being spaced apart by a distance that is greater than the width of said housing of said slide device, whereby said projections are engagable by said locking jaws when said locking jaws are in their extended positions.

5. An adjustable rack presentation system according to claim 1, wherein said first locking jaw and said second locking jaw each includes guiding means for guiding said first and second locking jaws as they move in said second guide grooves, said guiding means including a rib extending from a backside of each of said locking jaws.

6. An adjustable rack presentation system according to claim 1, wherein said first and second locking jaws are arranged symmetrically with respect to each other about said central longitudinal axis.

* * * * *